US007799147B2

(12) United States Patent
Matsukawa et al.

(10) Patent No.: US 7,799,147 B2
(45) Date of Patent: Sep. 21, 2010

(54) FLAKY SOFT MAGNETIC METAL POWDER AND MAGNETIC CORE MEMBER FOR RFID ANTENNA

(75) Inventors: Atsuhito Matsukawa, Tokyo (JP); Katsuhiko Wakayama, Tokyo (JP); Yoshihito Hirai, Tokyo (JP)

(73) Assignee: TDK Corporation, Tokyo (JP)

( * ) Notice: Subject to any disclaimer, the term of this patent is extended or adjusted under 35 U.S.C. 154(b) by 671 days.

(21) Appl. No.: 11/686,386

(22) Filed: Mar. 15, 2007

(65) Prior Publication Data

US 2007/0221297 A1 Sep. 27, 2007

(30) Foreign Application Priority Data

Mar. 27, 2006 (JP) ..... 2006-084959

(51) Int. Cl.
*H01F 1/147* (2006.01)
*H01F 1/20* (2006.01)

(52) U.S. Cl. ..... 148/307; 148/306; 420/34; 420/104; 420/117

(58) Field of Classification Search ..... None
See application file for complete search history.

(56) References Cited

U.S. PATENT DOCUMENTS 5,207,841 A 5/1993 Shigeta et al.
2004/0219328 A1* 11/2004 Tasaki et al. ..... 428/65.3

FOREIGN PATENT DOCUMENTS

| | | | |
|---|---|---|---|
| JP | 03-201415 | A | 9/1991 |
| JP | 03-295206 | A | 12/1991 |
| JP | 10-004004 | A | 1/1998 |
| JP | 2003-046321 | A | 2/2003 |
| JP | 2004-052095 | A | 2/2004 |
| JP | 2005-340759 | A | 12/2005 |
| JP | 2006-135037 | A | 5/2006 |

* cited by examiner

*Primary Examiner*—John P Sheehan
(74) *Attorney, Agent, or Firm*—Pearne & Gordon LLP

(57) ABSTRACT

The performance index μ'×Q of a magnetic core member, in which an Fe—Si—Cr alloy is used, is further improved. A flaky soft magnetic metal powder, which is used in a magnetic core member for an RFID antenna comprising the above flaky soft magnetic metal powder and a binder, wherein it is composed of an Fe—Si—Cr alloy having an Ms (saturation magnetization)/Hc (coercive force) of 0.8 to 1.5 ($mT/Am^{-1}$) in an applied magnetic field of 398 kA/m. In the present invention, it is preferable that the flaky soft magnetic metal powder consists of 7 to 23 at % of Si, 15 at % or less of Cr (excluding 0), and the balance being Fe and inevitable impurities, and that it has a weight-average particle size $D_{50}$ of 5 to 30 μm and an average thickness of 0.1 to 1 μm.

11 Claims, 5 Drawing Sheets

FLAKY SOFT MAGNETIC METAL POWDER AND MAGNETIC CORE MEMBER FOR RFID ANTENNA

BACKGROUND OF THE INVENTION

1. Field of the Invention

The present invention relates to a magnetic core member for an antenna that is preferably used in a non-contact IC tag or the like, in which RFID (Radio Frequency Identification) technique is used.

2. Description of the Related Art

As a non-contact IC card and a non-contact IC tag such as an identification tag, in which RFID technique is used, a product obtained by electrically connecting an IC chip for recording information and a resonant condenser with an antenna coil have been known. This non-contact IC tag is activated by transmission of electric wave having a certain frequency from the send/receive antenna of a reader/writer to an antenna coil, and it reads information recorded in an IC chip in response to the read command of the data communication of the electric wave, or it determines whether or not it resonates to the electric wave with a certain frequency, so as to conduct identification or monitoring. In addition, a majority of non-contact IC tags are designed to be able to update the read information, or it is possible to write history information into such tags.

As an antenna module used in such an identification tag, Japanese Patent Laid-Open No. 2000-48152 discloses an antenna module produced by inserting a magnetic core member into an antenna coil, which is wound spirally in a plane, such that the above member can be substantially in parallel with the plane, for example. The magnetic core member in this antenna module comprises a material having a high magnetic permeability, such as an amorphous sheet or an electromagnetic steel sheet. By inserting such a magnetic core member into an antenna coil such that the member can be substantially in parallel with the plane of the antenna coil, the inductance of the antenna coil is increased, so as to improve communication distance.

With regard to this magnetic core member, for the purpose of suppressing generation of eddy current and reducing the loss caused by such generation of eddy current, Japanese Patent Laid-Open No. 2004-52095 proposes that 90 wt % or more of iron-base alloy granular powders contained in a magnetic core member used in an RFID antenna are composed of powders having a particle size of 30 μm or less, and that such powders have a specific resistance of $80\times18^{-8}$ Ωm or more. This iron-base alloy may comprise 6 to 15 wt % of Si, and may also comprise at least one selected from 1 wt % or less of aluminum, 3 wt % or less of copper, 3 wt % or less of nickel, 5 wt % or less of chrome, and 10 wt % or less of cobalt. The above document describes that a Q value of 30 or greater can be obtained using such iron-base alloy granular powders.

Japanese Patent Laid-Open No. 2005-340759 describes that as a result of intensive studies directed towards providing a magnetic core member used in an antenna module, which is able to improve communication distance without increasing the thickness of the module, the inventors have focused on the loss coefficient in the used frequency (e.g. 13.56 MHz) of a magnetic core member, and they have found that the communication distance can be improved without increasing the thickness of the module, by producing a magnetic core member having a product with a certain value or greater of the reciprocal of the loss coefficient and the real part of a complex magnetic permeability. When the reciprocal of the loss coefficient (tan $\delta=\mu''/\mu'$) indicated by the real part μ' and imaginary part μ" of the complex magnetic permeability in the used frequency of a magnetic core member is represented by Q, if a performance index indicated by μ'×Q is set at 300 or greater, the power loss of the antenna module caused by eddy current loss can be reduced. Thus, without increasing the layer thickness of the magnetic core member, the communication distance can be improved.

Japanese Patent Laid-Open No. 2005-340759 discloses a magnetic core member, in which an Fe—Si based alloy is used. This document discloses that the performance index μ'×Q of a magnetic core member, in which an Fe-10 wt % Si—Cr alloy is used, is approximately 2,000.

It is an object of the present invention to further improve the performance index μ'×Q of the above magnetic core member, in which an Fe—Si—Cr alloy is used.

SUMMARY OF THE INVENTION

The present inventors have found that the aforementioned object of the present invention can be achieved by determining the Ms (saturation magnetization)/Hc (coercive force) of a flaky soft magnetic metal powder used in a magnetic core member for an antenna. That is to say, the present invention relates to a flaky soft magnetic metal powder, which is used in a magnetic core member for an RFID antenna comprising the above described flaky soft magnetic metal powder and a binder, wherein it is composed of an Fe—Si—Cr alloy having an Ms (saturation magnetization)/Hc (coercive force) of 0.8 to 1.5 ($mT/Am^{-1}$) in an applied magnetic field of 398 kA/m.

In the present invention, the flaky soft magnetic metal powder comprises 7 to 23 at % of Si, 15 at % or less of Cr (excluding 0), and the balance being Fe and inevitable impurities, and when its weight-average particle size $D_{50}$ is 5 to 30 μm and its average thickness is 0.1 to 1 μm, Ms/Hc can be set at 0.8 to 1.5 ($mT/Am^{-1}$) in an applied magnetic field of 398 kA/m.

In addition, the present invention provides a magnetic core member for an RFID antenna, which consists of a flaky soft magnetic metal powder and a binder, wherein the above described flaky soft magnetic metal powder is composed of an Fe—Si—Cr alloy having an Ms (saturation magnetization)/Hc (coercive force) of 0.8 to 1.5 ($mT/Am^{-1}$) in an applied magnetic field of 398 kA/m. As stated above, it is preferable that the above described flaky soft magnetic metal powder comprises 7 to 23 at % of Si, 15 at % or less of Cr (excluding 0), and the balance being Fe and inevitable impurities, and that it has a weight-average particle size $D_{50}$ of 5 to 30 μm and an average thickness of 0.1 to 1 μm.

As described above, the present invention has enabled the achievement of a performance index μ'×Q of 2,500 or greater by setting the Ms/Hc of a flaky soft magnetic metal powder comprising an Fe—Si—Cr alloy at 0.8 to 1.5 ($mT/Am^{-1}$).

DETAILED DESCRIPTION OF THE PREFERRED EMBODIMENTS

The present invention will be described below based on the following embodiments.

Figure 1:
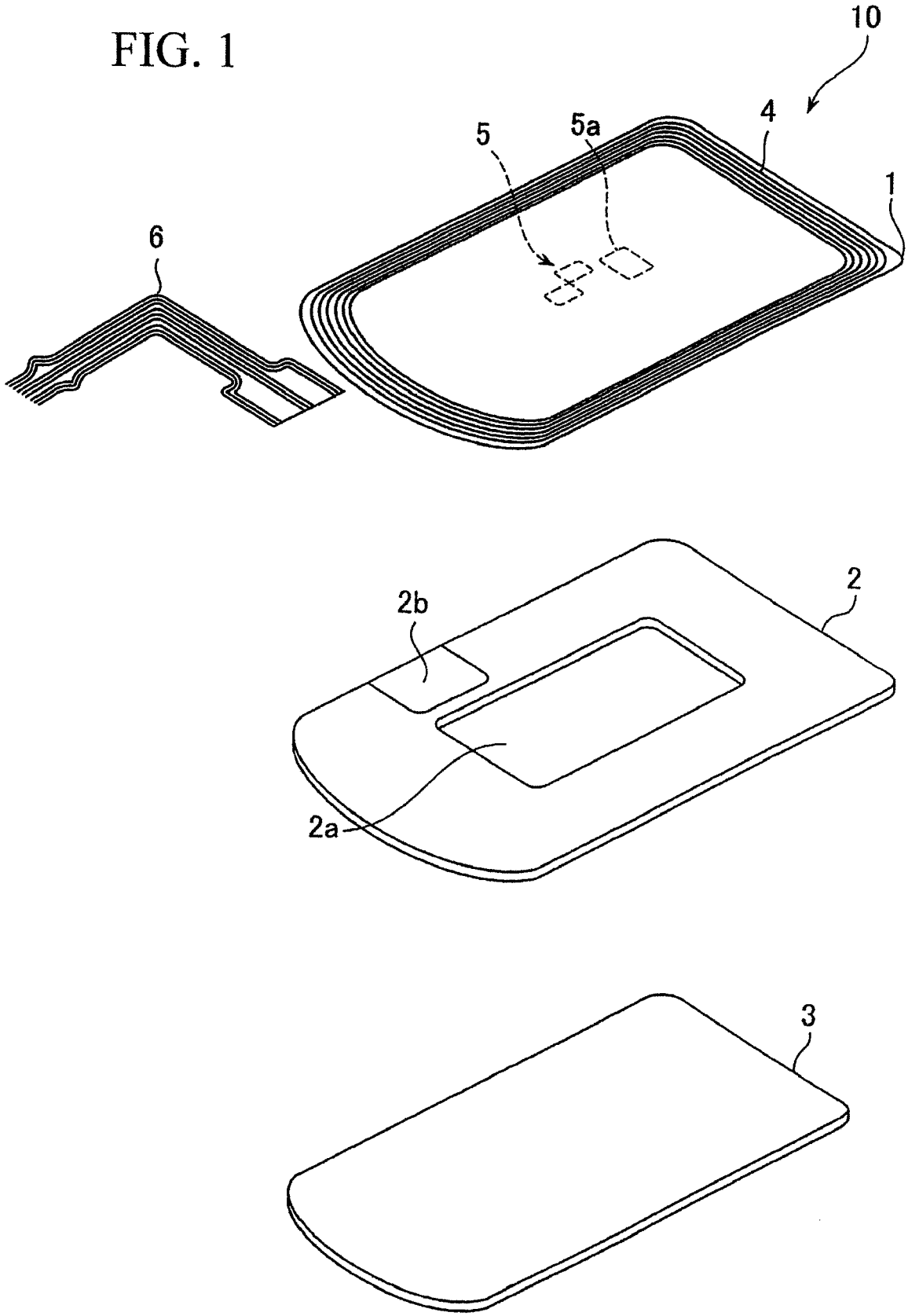
FIG. 1 is an exploded perspective view showing an antenna module used for non-contact data communication, in which the magnetic core member of the present invention is used.

FIG. 1 is an exploded perspective view showing an antenna module 10 used for non-contact data communication, in which the magnetic core member of the present invention is used.

In the antenna module 10 shown in FIG. 1, a substrate 1 used as a supporting member, a magnetic core member 2, and a metal shield 3 form a laminated structure. The substrate 1 and the magnetic core member 2, and the magnetic core 2 and the metal shield 3, are laminated via a double-faced adhesive sheet, for example.

The substrate 1 is equipped with an antenna coil 4 that is wounded in a loop in a plane. The antenna coil 4 is used for the functions of a non-contact IC tag, and it is inductively coupled with an external reader/writer antenna unit that is not shown in the figure, so as to conduct communication. The antenna coil 4 is composed of a metal pattern such as copper or aluminum patterned on the substrate 1.

A signal processing circuit 5 that is electrically connected with the antenna coil 4 is provided on the surface on the side of the magnetic core member 2 of the substrate 1. The signal processing circuit 5 is composed of electric or electronic components, such as an IC chip 5*a* for storing a signal processing circuit and information necessary for non-contact data communication, or a tuning condenser. The signal processing circuit 5 is connected with the printed wiring board of a portable information terminal that is not shown in the figure via an external connection unit 6 equipped in the substrate 1.

With regard to the magnetic core member 2, soft magnetic metal powders are mixed into an insulative binder such as a synthetic resin material or rubber, so as to form a sheet, for example. The present invention is characterized by such soft magnetic metal powders. Such characteristics will be described later. The magnetic core member 2 functions as a magnetic core (core) of the antenna coil 4, and at the same time, it is placed between the substrate 1 and the metal shield 3 as a lower layer, so as to avoid electromagnetic interference occurring between the antenna coil 4 and the metal shield 3. An opening 2*a* for accommodating the signal processing circuit 5 mounted on the substrate 1 is formed in the center of the magnetic core member 2. In addition, a concave portion 2*b*, in which an external connection unit 6 is placed during lamination on the substrate 1, is formed on one side of the magnetic core member 2.

The metal shield 3 is composed of a stainless plate, a copper plate, an aluminum plate, or the like. Since the antenna module 10 is stored in a certain position in the portable information terminal, the metal shield 3 is provided in order to protect the antenna coil 4 from the electromagnetic interference with metal parts (components, wirings) on the printed wiring board in the terminal body.

Next, the magnetic core member 2 will be described in detail.

The magnetic core member 2 is a sheet-shaped member comprising an insulative binder such as a synthetic resin and an Fe—Si—Cr alloy powder as described later. In the present invention, when the reciprocal of the loss coefficient (tan δ=μ"/μ') indicated by the real part μ' and imaginary part μ" of the complex magnetic permeability (μ=μ'−i·μ", wherein i represents an imaginary unit) in the used frequency (13.56 MHz in the present invention) of the magnetic core member 2 is represented by Q (μ'/μ"), a performance index indicated by μ'×Q can be set at 2,500 or greater. Such a magnetic core member 2 can be realized by using an Fe—Si—Cr alloy powder, wherein it has an Ms (saturation magnetization)/Hc (coercive force) of 0.8 to 1.5 ($mT/Am^{-1}$) in an applied magnetic field of 398 kA/m. Ms/Hc in an applied magnetic field of 398 kA/m is preferably 0.9 to 1.45 $mT/Am^{-1}$, and more preferably 1.0 to 1.4 $mT/Am^{-1}$. By setting such Ms/Hc within a preferred range, the performance index μ'×Q can be set at 3,000 or greater, and more preferably 4,000 or greater.

Japanese Patent Laid-Open No. 2005-340759 describes that a magnetic powder having a small eddy current loss is used, so as to reduce the imaginary part (loss term) μ" component of the complex magnetic permeability of the magnetic core member 2, and so as to contribute to a reduction in the loss coefficient. However, according to the studies of the present inventors, a prime factor for the loss of the magnetic core member 2 is considered to be magnetic domain wall resonance. Thus, in the present invention, the inventors' attention is focused on the fact that a high performance index μ'×Q can be obtained by setting Ms/Hc within the aforementioned range.

In order to set the Ms/Hc of an Fe—Si—Cr alloy powder within a range between 0.8 and 1.5 $mT/Am^{-1}$, the Fe—Si—Cr alloy may comprise 7 to 23 at % of Si, 15 at % or less of Cr (excluding 0), and the balance being Fe and inevitable impurities. If the Si amount of the Fe—Si—Cr alloy is less than 7 at %, Ms/Hc becomes less than 0.8 $mT/Am^{-1}$, and at the same time, the performance index μ'×Q becomes only approximately 2,000. On the other hand, if the Si amount of the Fe—Si—Cr alloy exceeds 23 at %, Ms/Hc exceeds 1.5 $mT/Am^{-1}$, and at the same time, the performance index μ'×Q becomes only approximately 2,000. Thus, the Si amount is preferably 10 to 20 at %, and more preferably 12 to 17 at %.

In the Fe—Si—Cr alloy of the present invention, Cr is able to impart corrosion resistance to the alloy. However, if the amount of Cr increases, saturation magnetization Ms decreases. If the amount of Cr is 15 at % or less (excluding 0), the effects of the present invention can sufficiently be enjoyed. The Cr amount is preferably 0.5 to 5 at %, and more preferably 0.5 to 3 at %.

The Fe—Si—Cr alloy powder of the present invention has a weight-average particle size $D_{50}$ (hereinafter simply referred to as $D_{50}$) of 5 to 30 μm. If $D_{50}$ is greater than 30 μm, there is a great fear that Ms/Hc exceeds 1.5 $mT/Am^{-1}$. Thus, in the present invention, the upper limit of the $D_{50}$ of the Fe—Si—Cr alloy powder is set at 30 μm. In addition, if the Fe—Si—Cr alloy powder is too small, there is a great fear that Hc increases and that Ms/Hc becomes less than 0.8 $mT/Am^{-1}$. Thus, the $D_{50}$ of the Fe—Si—Cr alloy powder is preferably set at 5 μm or greater. The $D_{50}$ of the Fe—Si—Cr alloy powder is more preferably 10 to 25 μm, and further more preferably 15 to 25 μm. It is to be noted that the weights of particles constituting the Fe—Si—Cr alloy powder are added up in an increasing order of particle size, and that when the obtained value reaches 50% of the weight of the entire Fe—Si—Cr alloy powder, the particle size (the length of the long axis) of the Fe—Si—Cr alloy particle is defined as $D_{50}$. Further, the particle size in this case can be measured by the light scattering method. While the target to be measured is circulated for example, the scattering angle of Fraunhofer diffraction or Mie scattering using laser beam, halogen lamp, or the like, as a light source, and particle size distribution is then measured.

The Fe—Si—Cr alloy powder of the present invention has a thickness of 0.1 to 1 μm, and a more preferred range of such a thickness is 0.3 to 0.7 μm. If the thickness of the Fe—Si—Cr alloy powder is less than 0.1 μm, the production thereof is difficult, and it is also difficult to handle such a powder. In contrast, if the thickness exceeds 1 μm, the demagnetizing field becomes large, and the apparent μ' decreases. Thus, this is not preferable.

Moreover, in the Fe—Si—Cr alloy powder of the present invention, the range of an aspect ratio (=average particle size $D_{50}$/average thickness) is preferably set between 10 and 200, and more preferably set between 20 and 100. If the aspect ratio becomes less than 10, the demagnetizing field becomes large. When this is reflected upon the Fe—Si—Cr alloy powder, the apparent magnetic permeability decreases. In contrast, if the aspect ratio becomes more than 200, a packing ratio (=the volume of the Fe—Si—Cr alloy powder/the volume of magnetic core member 2) decreases, and the magnetic permeability also decreases.

The Fe—Si—Cr alloy powder of the present invention can be obtained by producing a raw material alloy powder having the aforementioned composition and then subjecting the raw material alloy powder to a flaking treatment. Such a raw material alloy powder may be obtained by crushing an ingot, or may be obtained by a melt quenching method such as water atomization, gas atomization, or a roll quenching method. The $D_{50}$ of the raw material alloy powder is preferably set at 15 μm or less. If the $D_{50}$ Of the raw material alloy powder exceeds 15 μm, it becomes difficult to adjust the $D_{50}$ to 30 μm or less by a flaking treatment.

The type of a method of flaking the raw material alloy powder is not particularly limited. Any type of method may be applied, as long as it enables a desired flaking. For example, a medium agitation mill, a tumbling ball mill, or the like is used to carry out a flaking treatment. It is particularly preferable to use a medium agitation mill. A medium agitation mill is an agitator, which is also referred to as a pin-type mill, a bead mill, or an agitator ball mill. A flaking treatment is preferably carried out in a wet process using an organic solvent such as toluene. At that time, the particle size distribution of the Fe—Si—Cr alloy powder is not necessarily sharp, and it may have a distribution comprising two peaks.

<Heat Treatment>

After completion of the flaking treatment, a heat treatment is carried out. By such a heat treatment, the flaked Fe—Si—Cr alloy powder is dried, and further, a distortion caused by flaking is eliminated. This heat treatment may be carried out in the atmosphere, or may also be carried out in inert gas (e.g. nitrogen) that contains a certain amount of oxygen (e.g. an oxygen partial pressure of 1% or less).

As a temperature applied during such a heat treatment, a stable temperature is set between 275° C. and 450° C., and more preferably between 300° C. and 400° C. In addition, a stable time is preferably set between 30 and 180 minutes. This is because if the heat treatment is carried out outside the aforementioned temperature range, the coercive force Hc of the Fe—Si—Cr alloy obtained after the heat treatment becomes high. It is preferable to carry out the heat treatment within the aforementioned temperature range that includes a temperature at which the coercive force Hc becomes the minimum value.

It is preferable that the aforementioned stable temperature is changed as appropriate depending on the composition of the Fe—Si—Cr alloy powder, so as to apply optimal conditions. For example, when x=15 in $Fe_{98.5-x}Si_xCr_{1.5}$ alloy (at %), the stable temperature is set preferably between 325° C. and 450° C., and more preferably between 350° C. and 400° C. In addition, when x=21, the stable temperature is set preferably between 275° C. and 375° C., and more preferably between 300° C. and 350° C.

The Fe—Si—Cr alloy powder obtained as described above comprises 7 to 23 at % of Si, 15 at % or less of Cr (excluding 0), and the balance being Fe and inevitable impurities, and it has $D_{50}$ of 5 to 30 μm and an average thickness of 0.1 to 1 μm. Using this Fe—Si—Cr alloy powder, the magnetic core member 2 can be produced as follows.

After the Fe—Si—Cr alloy powder has been mixed with a binder, the obtained mixture is subjected to press molding or extrusion molding, so as to convert it to a sheet form. Otherwise, the Fe—Si—Cr alloy powder and a binder are dispersed in an organic solvent, and the resultant is then processed into a film having a certain thickness according to the doctor blade method. Thereafter, the film is dried, and the dried film is then rolled with a calendar roll, so as to convert it to a sheet-like form. Thus, the magnetic core member 2 having a thickness of 0.05 to 2 mm can be obtained.

The thickness of the magnetic core member 2 is set between 0.05 and 2 mm for the following reason. That is, there are the following constraint conditions. If the thickness of the magnetic core member 2 is thinner than 0.05 mm, a sufficient communication distance cannot be obtained. On the other hand, if the thickness of the magnetic core member 2 exceeds 2 mm, it becomes difficult to accommodate the above member in a narrow space in the package of an electrical apparatus.

The packing ratio of the Fe—Si—Cr alloy powder in the magnetic core member 2 is preferably between 60 wt % and 95 wt %. If the packing ratio is less than 60 wt %, μ' becomes small. If it exceeds 95 wt %, the Fe—Si—Cr alloy powders cannot strongly bind to one another via a binder, so that the strength of the magnetic core member 2 decreases. The filling ratio is more preferably between 70 wt % and 90 wt %.

Examples of a binder used herein may include known thermoplastic resins, thermosetting resins, UV curing resins, radiation curing resins, rubber materials and the like. Specific examples may include a polyester resin, a polyethylene resin, a polyvinyl chloride resin, a polyvinyl butyral resin, a polyurethane resin, a cellulose resin, an ABS resin, a nitrile-butadiene rubber, a styrene-butadiene rubber, an epoxy resin, a phenol resin, and an amide resin.

It is to be noted that the magnetic core member 2 may comprise a hardening agent, a dispersant, a stabilizer, a coupling agent, and the like, as well as the Fe—Si—Cr alloy powder and the binder. Moreover, when the magnetic core member 2 of the present invention is molded or applied into a certain form, magnetic field for orientation is applied to the magnetic core member 2, or the magnetic core member 2 is mechanically oriented, so as to achieve the magnetic core member 2 having high orientation.

EXAMPLES

An Fe—Si—Cr raw material alloy powder having the composition shown in Table 1 (Si=4 to 28 at %, and Cr=1 to 15 at %) was produced by the water atomization method. The raw material alloy powder was subjected to a flaking treatment using a medium agitation mill in a toluene solvent, so as to obtain a flaky Fe—Si—Cr alloy powder having an average thickness of 0.1 to 1.0 μm. This alloy powder was subjected to a heat treatment, and the magnetic properties thereof (Ms: saturation magnetization; Hc: coercive force) were then measured using a vibrating sample magnetometer (VSM; applied magnetic field: 398 kA/m). The heat treatment was carried out at a temperature at which Hc (coercive force) became the minimum (300 to 400° C.). Moreover, the particle size $D_{50}$ of the flaky Fe—Si—Cr alloy powder was measured. It is to be noted that $D_{50}$ means 50% particle size measured by the light scattering method using HELOS SYSTEM (manufactured by JEOL; dry method) The results are also shown in Table 1.

Subsequently, using the above flaky Fe—Si—Cr alloy powder, a magnetic core member was produced by the following procedures.

The flaky Fe—Si—Cr alloy powder was mixed with 15 wt % of a binder, using a diluent. The obtained slurry was applied on a PET (Poly Ethylene Terephthalate) film, followed by magnetic field orientation. The flaky Fe—Si—Cr alloy powder was obtained by flaking for a treating time at which $D_{50}$ became the maximum. Magnetic field orientation was carried out by allowing it to pass between magnets in which the same poles were faced. Further, after formation of a multilayer, rolling and heat pressing were conducted, so as to obtain a sheet-like magnetic core member having a thickness of 0.5 mm and a density of 3.5 $Mg/M^3$. From this sheet, a toroidal sample having an outside diameter of 18 mm and an inside diameter of 10 mm was produced. Using an impedance analyzer (manufactured by Hewlett Packard; HP4281), the real part μ' of a complex magnetic permeability and the imaginary part μ" thereof were measured. Moreover, based on the measured real part μ' and imaginary part μ" of a complex magnetic permeability, the loss coefficient tan δ and the performance index μ'×Q were obtained. Furthermore, communication distance in a state where a sheet was incorporated into a personal digital assistant was evaluated. The obtained results are shown in Table 1. It is to be noted that the symbol fr shown in Table 1 represents a frequency (critical frequency) at which the imaginary part μ" of a complex magnetic permeability reaches a peak.

Figure 2:
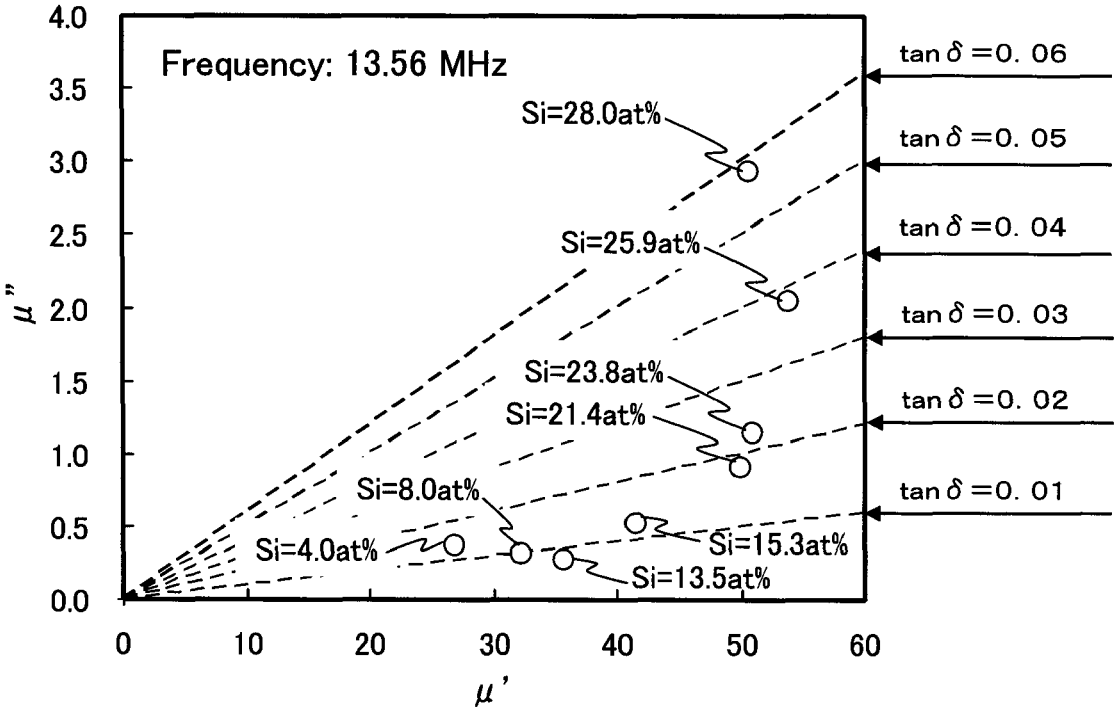
FIG. 2 is a graph showing the relationship between the real part μ' and imaginary part μ" of a complex magnetic permeability, and an Si amount.

FIG. 2 is a graph showing the relationship between the real part μ' and imaginary part μ" of a complex magnetic permeability, and an Si amount, in each of Comparative example 1 (Si=28.0 at %), Comparative example 2 (Si=25.9 at %), Comparative example 3 (Si=23.8 at %), Example 2 (Si=21.4 at %), Example 6 (Si=15.3 at %), Example 8 (Si=13.5 at %), Example 10 (Si=8.0 at %), and Comparative example 9 (Si=4.0 at %). From FIG. 2, it is found that as the Si amount decreases, the loss coefficient tan δ (=μ"/μ') decreases, but that the loss coefficient tan δ (=μ"/λ') shifts to increase on reaching Si=13.5 at %.

It is to be noted that Comparative example 1, Comparative example 2, Comparative example 3, Example 2, Example 6, Example 8, Example 10, and Comparative example 9 are common in terms of a Cr amount of approximately 1.5 at % and $D_{50}$ of approximately 20 μm.

Figure 3:
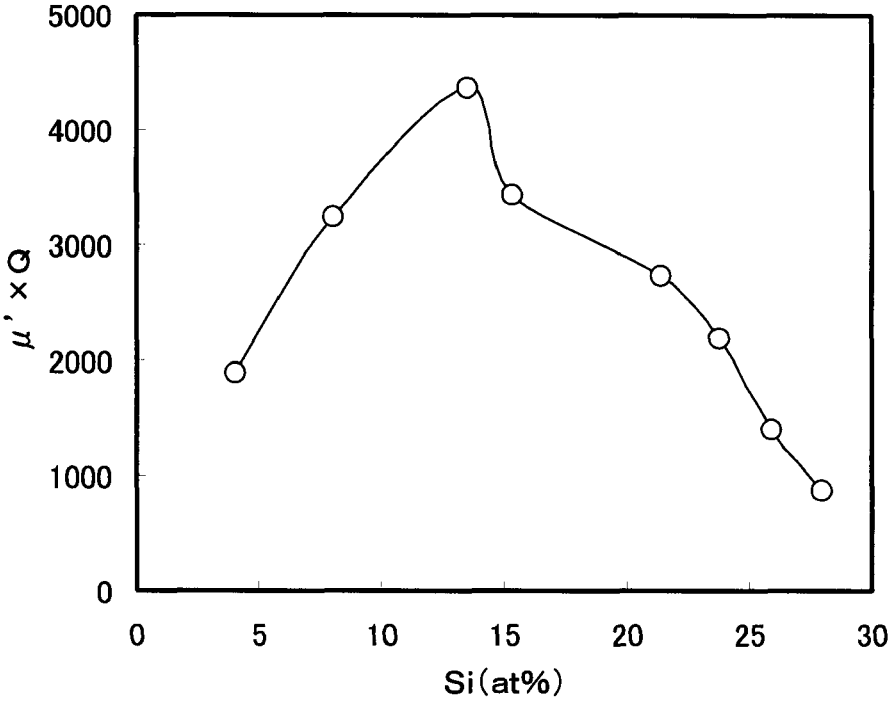
FIG. 3 is a graph showing the relationship between an Si amount and the performance index (μ'×Q) of a magnetic sheet.

FIG. 3 is a graph showing the relationship between an Si amount and the performance index (μ'×Q) of a magnetic sheet, in each of Comparative example 1 (Si=28.0 at %), Comparative example 2 (Si=25.9 at %), Comparative example 3 (Si=23.8 at %), Example 2 (Si=21.4 at %), Example 6 (Si=15.3 at %), Example 8 (Si=13.5 at %), Example 10 (Si=8.0 at %), and Comparative example 9 (Si=4.0 at %). From this graph, it is found that a high performance index μ'×Q can be obtained by setting the Si amount within a certain range.

As described above, if the Si amount of the Fe—Si—Cr alloy is set within a certain range, a high performance index μ'×Q can be obtained. However, there are several exceptions. Such exceptions are Comparative example 5, Comparative example 6, and Comparative example 7 shown in Table 1. These magnetic core members contain Si amounts of 18.5 at % and 21.4 at %. Thus, these members have compositions for achieving a high performance index μ'×Q in FIG. 3. However, the actual performance index μ'×Q remains a value ranging between 2,000 and 2,300. That is, a high performance index μ'×Q cannot be obtained only by specifying the Si amount. Hence, studies will be further advanced.

Figure 4:
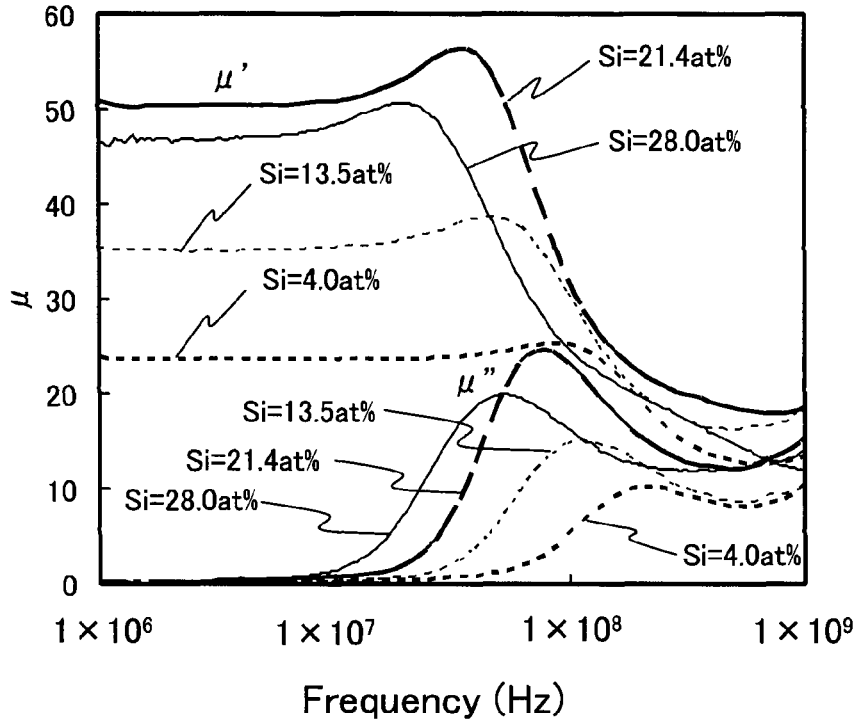
FIG. 4 is a graph showing the frequency characteristics of complex magnetic permeability μ of magnetic sheets having different Si amounts.

FIG. 4 is a graph showing the frequency characteristics of magnetic permeability μ in each of Comparative example 1 (Si=28.0 at %), Example 2 (Si 21.4 at %), Example 8 (Si=13.5 at %), and Comparative example 9 (Si=4.0 at %). From FIG. 4, it is found that as the Si amount of the Fe—Si—Cr alloy decreases, the critical frequency fr (the position of the peak of the imaginary part μ" of complex magnetic permeability) shifts to a high frequency.

Figure 5:
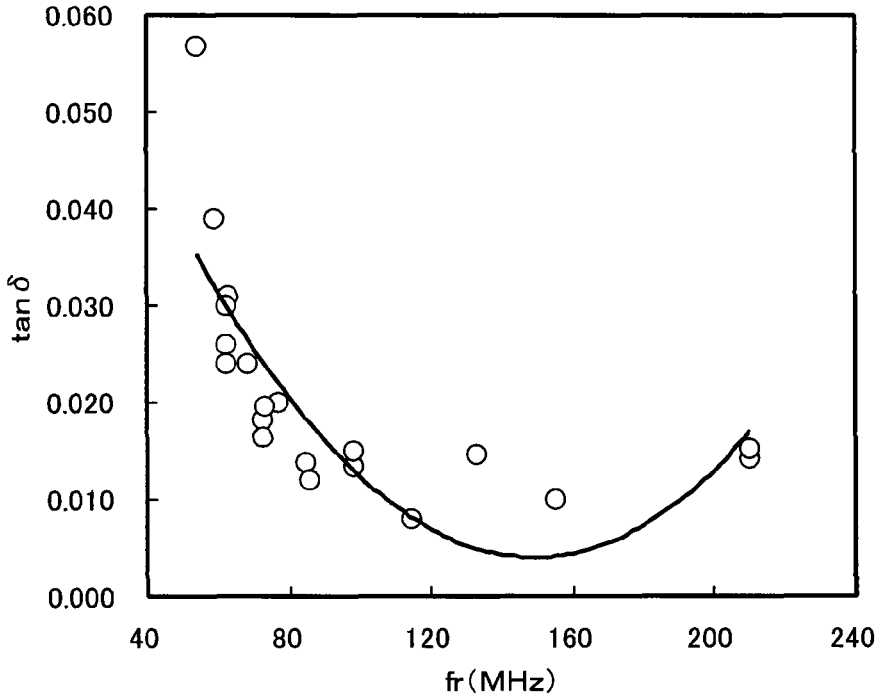
FIG. 5 is a graph showing the relationship between the critical frequencies fr and loss coefficients tan δ of magnetic sheets.

FIG. 5 is a graph showing the relationship between the critical frequencies fr and loss coefficients tan δ in all the examples and comparative examples shown in Table 1. It is found that as the critical frequency fr increases, the loss coefficient tan δ decreases, but that the loss coefficient tan δ shifts to increase from a point of approximately 150 MHz.

Figure 6:
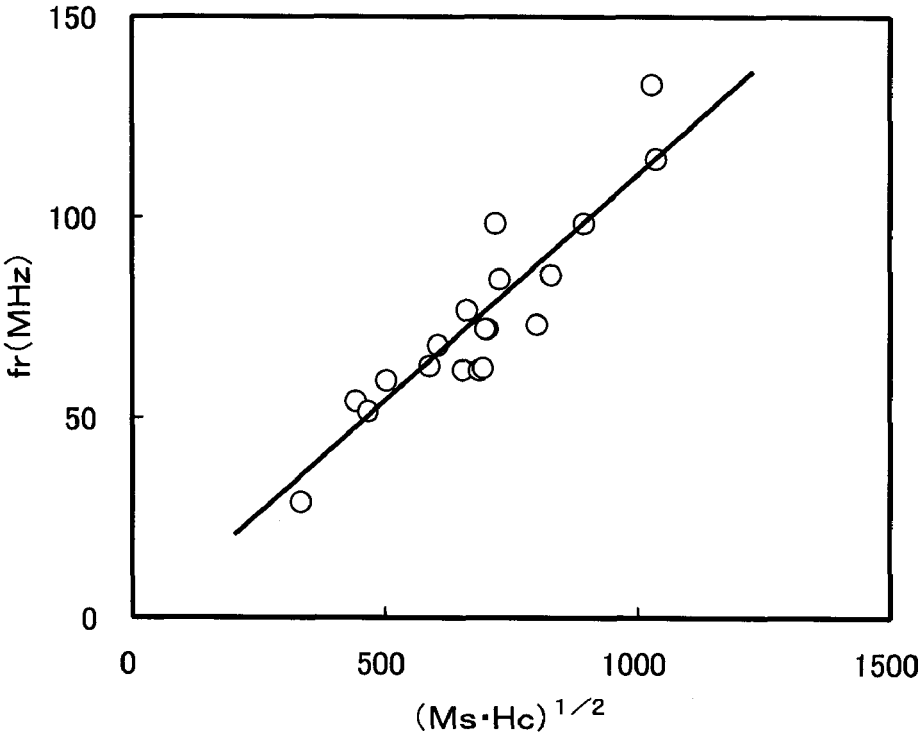
FIG. 6 is a graph showing the relationship between the values of $(Ms/Hc)^{1/2}$ and critical frequencies fr of flaky Fe—Si—Cr alloy powders.

FIG. 6 is a graph showing the relationship between the values of $(Ms \cdot Hc)^{1/2}$ (Ms: saturation magnetization, Hc: coercive force) and critical frequencies fr of the flaky Fe—Si—Cr alloy powders. Herein, it is said that a magnetic domain wall resonance frequency that is one of residual losses is in proportion to $Ms/\mu^{1/2}$ (refer to Jikikogaku no kiso II (Basic Magnetics II), pp. 313-317, Kyoritsu Zensho, for example). If Ms/Hc is defined as a characteristic substituted for the magnetic permeability μ of the above material, $Ms/\mu^{1/2}$ is considered to be in proportion to $(Ms \cdot Hc)^{1/2}$. According to FIG. 6, since the $(Ms \cdot Hc)^{1/2}$ of the flaky Fe—Si—Cr alloy powder is in proportion to the critical frequency fr, it is understood that the critical frequency fr is a magnetic domain wall resonance frequency.

In general, the loss coefficient tan δ is represented by the sum of a hysteresis loss (tan δh), an eddy current loss (tan δe), and a residual loss (tan δr). The residual loss is considered to be a loss obtained by eliminating the hysteresis loss (tan δh) and the eddy current loss (tan δe) from the total loss. The residual loss includes magnetic domain wall resonance and natural resonance. Taking into consideration that natural resonance appears on a higher frequency side, based on the frequency, the critical frequency fr is considered to be caused by magnetic wall resonance.

Figure 7:
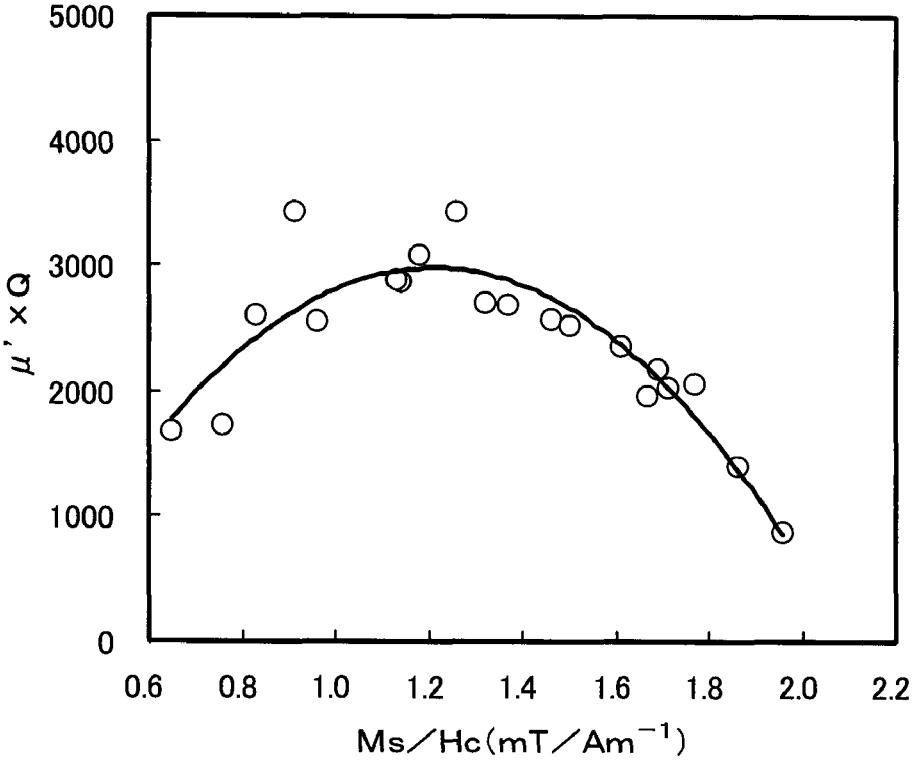
FIG. 7 is a graph showing the Ms/Hc (saturation magnetization/coercive force) of flaky Fe—Si—Cr alloy powders and the performance indexes (μ'×Q) of magnetic sheets.

Thus, the relationship between the Ms/Hc (saturation magnetization/coercive force) of the flaky Fe—Si—Cr alloy powders and the performance indexes μ'×Q of magnetic sheets is shown in FIG. 7. As the performance index μ'×Q of the magnetic core member used in an RFID antenna increases, communication distance increases. By setting the Ms/Hc of the flaky Fe—Si—Cr alloy powder within a range between 0.8 and 1.5, a performance index μ'×Q of 2,500 or greater can be obtained.

In the case of Comparative example 5, Comparative example 6, and Comparative example 7, which have Si amounts of 18.5 at % and 21.4 at %, the Ms/Hc of the flaky Fe—Si—Cr alloy powder exceeds 1.5. In addition, in the case of Comparative example 5, Comparative example 6, and Comparative example 7, the $D_{50}$ of the flaky Fe—Si—Cr alloy powder exceeds 30 μm. Moreover, in the case of Comparative example 8, the average thickness of the flaky Fe—Si—Cr alloy powder exceeds 1 μm. Accordingly, it has been revealed that in order to set Ms/Hc within a range between 0.8 and 1.5, the particle size of the flaky Fe—Si—Cr alloy powder is also important.

Figure 8:
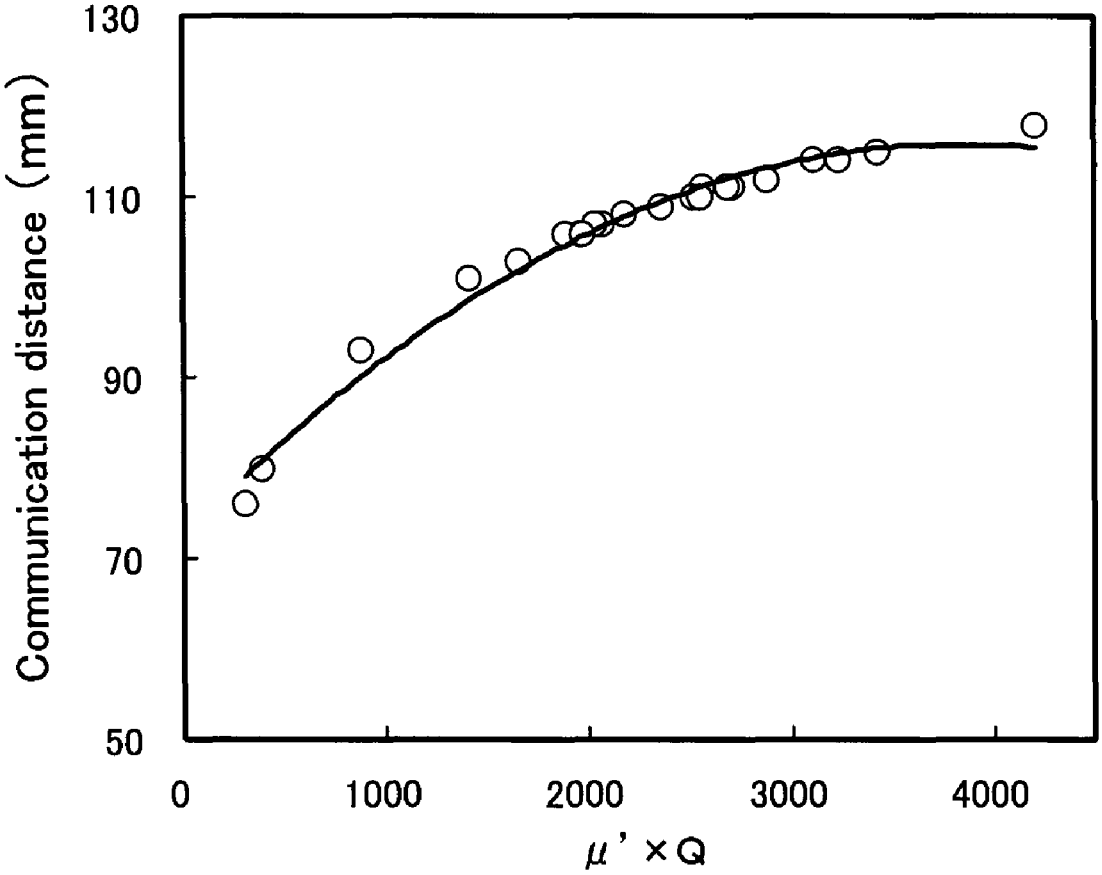
FIG. 8 is a graph showing the relationship between the performance indexes (μ'×Q) of magnetic sheets comprising flaky Fe—Si—Cr alloy powders and communication distances.

FIG. 8 is a graph showing the relationship between the performance indexes μ'×Q of magnetic sheets comprising the flaky Fe—Si—Cr alloy powders and communication distances. By setting the performance index μ'×Q at 2,500 or greater, a communication distance of 110 mm or more can be obtained.

As stated above, it was newly found in the present invention that the Ms/Hc of the flaky Fe—Si—Cr alloy powder used as a guideline for controlling the performance index μ'×Q is specified within the range between 0.8 and 1.5. In order to specify Ms/Hc within the range between 0.8 and 1.5, it is important that the Si amount of the Fe—Si—Cr alloy, and the particle size and thickness of a soft magnetic metal powder be set within a certain range.

TABLE 1

| | Composition of alloy | | | Properties of flaky soft magnetic alloy powder | | | | | Properties of magnetic sheet | | | | | | Communication distance (mm) |
|---|---|---|---|---|---|---|---|---|---|---|---|---|---|---|---|
| | Si (at %) | Cr (at %) | Fe (at %) | $D_{50}$ (μm) | Thickness (μm) | Ms (mT) | Hc (A/m) | Ms/Hc (mT/Am$^{-1}$) | μ' | μ'' | tan δ at 13.56 MHz | Q | μ' × Q | fr (MHz) | |
| Comparative example 1 | 28.0 | 1.5 | Bal. | 18.6 | 0.98 | 620 | 317 | 1.96 | 49.5 | 2.82 | 0.0569 | 18 | 870 | 54 | 93 |
| Comparative example 2 | 25.9 | 1.5 | Bal. | 21.4 | 0.76 | 690 | 371 | 1.86 | 54.8 | 2.14 | 0.0390 | 26 | 1410 | 59 | 101 |
| Comparative example 3 | 23.8 | 1.6 | Bal. | 22.2 | 0.72 | 790 | 467 | 1.69 | 52.5 | 1.26 | 0.0240 | 42 | 2180 | 68 | 108 |
| Comparative example 4 | 23.8 | 1.6 | Bal. | 33.7 | 0.86 | 760 | 455 | 1.67 | 60.8 | 1.89 | 0.0311 | 32 | 1960 | 63 | 106 |
| Example 1 | 21.6 | 1.0 | Bal. | 20.0 | 0.65 | 810 | 613 | 1.32 | 48.8 | 0.88 | 0.0180 | 55 | 2710 | 72 | 111 |
| Example 2 | 21.4 | 1.6 | Bal. | 23.5 | 0.59 | 800 | 547 | 1.46 | 51.4 | 1.03 | 0.0200 | 50 | 2570 | 77 | 111 |
| Comparative example 5 | 21.4 | 1.6 | Bal. | 31.2 | 0.72 | 830 | 517 | 1.61 | 56.9 | 1.37 | 0.0241 | 42 | 2360 | 62 | 109 |
| Comparative example 6 | 21.4 | 1.6 | Bal. | 42.2 | 0.98 | 910 | 515 | 1.77 | 62.1 | 1.86 | 0.0300 | 33 | 2070 | 62 | 107 |
| Example 3 | 20.6 | 9.5 | Bal. | 23.5 | 0.59 | 790 | 669 | 1.18 | 42.8 | 0.59 | 0.0138 | 73 | 3110 | 84 | 114 |
| Example 4 | 20.4 | 15.0 | Bal. | 23.2 | 0.53 | 770 | 675 | 1.14 | 38.7 | 0.52 | 0.0134 | 74 | 2880 | 98 | 112 |
| Example 5 | 18.5 | 1.6 | Bal. | 18.8 | 0.44 | 820 | 598 | 1.37 | 44.0 | 0.72 | 0.0164 | 61 | 2690 | 72 | 111 |
| Comparative example 7 | 18.5 | 1.6 | Bal. | 30.8 | 0.75 | 910 | 532 | 1.71 | 52.8 | 1.37 | 0.0260 | 39 | 2030 | 62 | 107 |
| Example 6 | 15.3 | 1.6 | Bal. | 19.5 | 0.39 | 930 | 737 | 1.26 | 41.0 | 0.49 | 0.0120 | 84 | 3430 | 86 | 115 |
| Example 7 | 15.3 | 1.6 | Bal. | 27.3 | 0.47 | 980 | 654 | 1.50 | 49.7 | 0.98 | 0.0197 | 51 | 2520 | 73 | 110 |
| Example 8 | 13.5 | 1.7 | Bal. | 20.1 | 0.34 | 990 | 1089 | 0.91 | 35.6 | 0.29 | 0.0081 | 123 | 4380 | 114 | 118 |
| Example 9 | 13.5 | 1.7 | Bal. | 29.1 | 0.50 | 950 | 842 | 1.13 | 43.3 | 0.65 | 0.0150 | 67 | 2880 | 98 | 112 |
| Comparative example 8 | 13.5 | 1.7 | Bal. | 22.3 | 1.21 | 670 | 960 | 0.70 | 30.4 | 0.56 | 0.0184 | 54 | 1650 | 162 | 103 |
| Example 10 | 8.0 | 1.6 | Bal. | 22.4 | 0.31 | 1000 | 1258 | 0.80 | 32.2 | 0.32 | 0.0099 | 101 | 3240 | 155 | 114 |
| Example 11 | 8.0 | 1.6 | Bal. | 30.0 | 0.46 | 1010 | 1050 | 0.96 | 37.5 | 0.55 | 0.0147 | 68 | 2560 | 133 | 110 |
| Comparative example 9 | 4.0 | 1.6 | Bal. | 24.5 | 0.33 | 1030 | 1590 | 0.65 | 26.8 | 0.38 | 0.0142 | 71 | 1890 | 210 | 106 |
| Comparative example 10 | 4.0 | 1.6 | Bal. | 34.0 | 0.47 | 1100 | 1442 | 0.76 | 30.1 | 0.46 | 0.0153 | 65 | 1970 | 210 | 106 |
| Comparative example 11 | Sendust | | | 21.2 | 0.75 | 720 | 156 | 2.79 | 60.0 | 12.00 | 0.2000 | 5 | 300 | 29 | 76 |
| Comparative example 12 | Permalloy | | | 58.0 | 0.89 | 730 | 299 | 2.44 | 60.0 | 9.20 | 0.1533 | 7 | 390 | 51 | 80 |

What is claimed is:

1. A flaky soft magnetic metal powder, which is used in a magnetic core member for an RFID antenna comprising the flaky soft magnetic metal powder and a binder, wherein the flaky soft magnetic metal powder is composed of an Fe—Si—Cr alloy having an Ms (saturation magnetization)/Hc (coercive force) of 0.8 to 1.5 (mT/Am$^{-1}$) in an applied magnetic field of 398 kA/m, the flaky soft magnetic metal powder comprises 12 to 17 at % of Si, 0.5 to 5 at % of Cr, and the balance being Fe and inevitable impurities, the flaky soft magnetic metal powder has a weight-average article size $D_{50}$ of 5 to 30 μm, and an average thickness of 0.1 to 1 μm.

2. The flaky soft magnetic metal powder according to claim 1, wherein the amount of Cr is 0.5 to 3 at %.

3. The flaky soft magnetic metal powder according to claim 1, having the weight-average particle size $D_{50}$ of 10 to 25 μm.

4. The flaky soft magnetic metal powder according to claim 1, having the weight-average particle size $D_{50}$ of 15 to 25 μm.

5. The flaky soft magnetic metal powder according to claim 1, having the average thickness of 0.3 to 0.7 μm.

6. The flaky soft magnetic metal powder according to claim 1, having an Ms (saturation magnetization)/Hc (coercive force) of 0.9 to 1.45 (mT/Am$^{-1}$).

7. A magnetic core member for an RFID antenna, which comprises a flaky soft magnetic metal powder and a binder, wherein the flaky soft magnetic metal powder is composed of an Fe—Si—Cr alloy having an Ms (saturation magnetization)/Hc (coercive force) of 0.8 to 1.5 ($mT/Am^{-1}$) in an applied magnetic field of 398 kA/m, the flaky soft magnetic metal powder comprises 12 to 17 at % of Si, 0.5 to 5 at % of Cr, and the balance being Fe and inevitable impurities, the flaky soft magnetic metal powder has a weight-average particle size $D_{50}$ of 5 to 30 μm, and an average thickness of 0.1 to 1 μm.

8. The magnetic core member for an antenna according to claim 7, wherein the flaky soft magnetic metal powder has an Ms (saturation magnetization)/Hc (coercive force) of 0.9 to 1.45 ($mT/Am^{-1}$).

9. The magnetic core member for an antenna according to claim 7, having a thickness of 0.05 to 2 mm in a sheet-like form.

10. The magnetic core member for an antenna according to claim 7, wherein the packing ratio of the metal powder in the magnetic core member for an antenna is between 60 to 95 wt %.

11. The magnetic core member for an antenna according to claim 7, wherein the packing ratio of the metal powder in the magnetic core member for an antenna is between 70 to 90 wt %.

* * * * *

UNITED STATES PATENT AND TRADEMARK OFFICE

CERTIFICATE OF CORRECTION

PATENT NO. : 7,799,147 B2
APPLICATION NO. : 11/686386
DATED : September 21, 2010
INVENTOR(S) : Atsuhito Matsukawa et al.

It is certified that error appears in the above-identified patent and that said Letters Patent is hereby corrected as shown below:

Column 7, line 54, change:

"tan δ (=μ"/λ') shifts"

to:

--tan δ (=μ"/μ') shifts--

Signed and Sealed this
Twenty-first Day of June, 2011

David J. Kappos

David J. Kappos
*Director of the United States Patent and Trademark Office*